US005189977A

United States Patent [19]

Davidson

[11] Patent Number: 5,189,977

[45] Date of Patent: Mar. 2, 1993

[54] TILT-UP CURTAIN FOR SMALL BOATS

[75] Inventor: Samuel L. Davidson, Monroe, La.

[73] Assignee: Mastercrafters Corporation, Winnsboro, La.

[21] Appl. No.: 838,863

[22] Filed: Feb. 21, 1992

[51] Int. Cl.[5] ..... B63B 19/12

[52] U.S. Cl. ..... 114/201 R; 114/117

[58] Field of Search ..... 114/71, 117, 201 R, 114/343, 361

[56] References Cited

U.S. PATENT DOCUMENTS 3,039,417 6/1962 Hoffberg ..... 114/117

4,742,795 5/1988 De Pray et al. ..... 114/343

4,763,598 8/1988 Spencer ..... 114/361

*Primary Examiner*—Jesus D. Sotelo

*Attorney, Agent, or Firm*—Jacobson, Price, Holman & Stern

[57] ABSTRACT

To close off the cockpit of a small boat from a forward compartment of the boat, a lift-up panel hinged to the floor of the boat is provided to fit in the space between port and starboard consoles which separate the cockpit from the forward compartment. The panel fits against the floor of the boat when not in use and can readily be raised and lowered. Engagement of the panel with a central section of a windshield is provided to hold the panel in the raised position.

6 Claims, 2 Drawing Sheets

TILT-UP CURTAIN FOR SMALL BOATS

BACKGROUND OF THE INVENTION

This invention relates to means for closing off the cockpit area of a small boat, such as a recreational motor boat, a fishing boat, a ski boat or the like, from a forward compartment of the boat.

Traditionally, the cockpit area of a small boat is closed off from the forward compartment by a removable fabric curtain that snaps in place between port and starboard consoles under a center section of a windshield, thereby closing a space between the consoles which normally provides communication between the cockpit and the forward compartment. The curtain, however, tends to get dirty or lost, and can be difficult to snap in place particularly in heavy weather. Accordingly, it is an object of the invention to provide an improved means to serve this purpose.

SUMMARY OF THE INVENTION

According to the invention, there is provided a tilt-up panel or curtain hinged to the floor of the boat between the consoles to close off the cockpit area from the forward compartment. When not in use, the tilt-up panel may fit in a recess or well in the floor of the forward compartment, and when needed can be lifted into an operative position to seal the space between the consoles. To this end, the panel is shaped to conform with the shape of such space.

To locate the panel in operative position, there may be stops on the side faces of the respective consoles, and to hold the panel in place, the lower edge of the central windshield section may hinge closed against the top edge of the panel. Alternatively, the upper edge of the panel and lower edge of the central windshield section may have complimentary fastener elements.

It will be evident that the panel is very simple to manipulate and overcomes the problem of lost curtains. Additional features and advantages of the invention will be apparent from the ensuing description and claims read in conjunction with the attached drawings.

DESCRIPTION OF PREFERRED EMBODIMENTS

Figure 1:
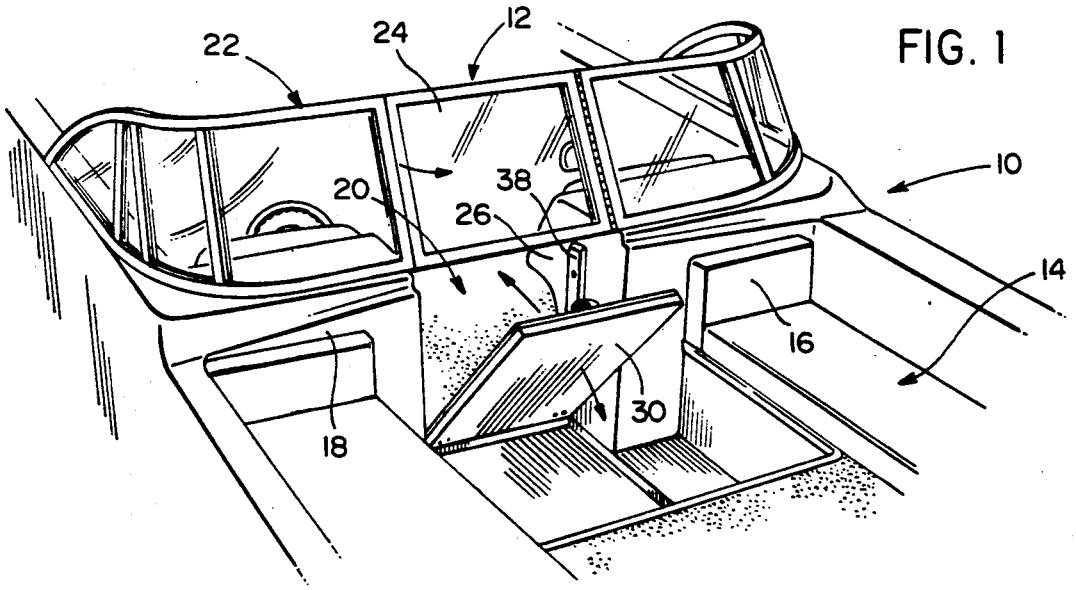
FIG. 1 is a perspective view from the front of part of a small motor boat having a tilt-up panel according to the invention.
Figure 2:
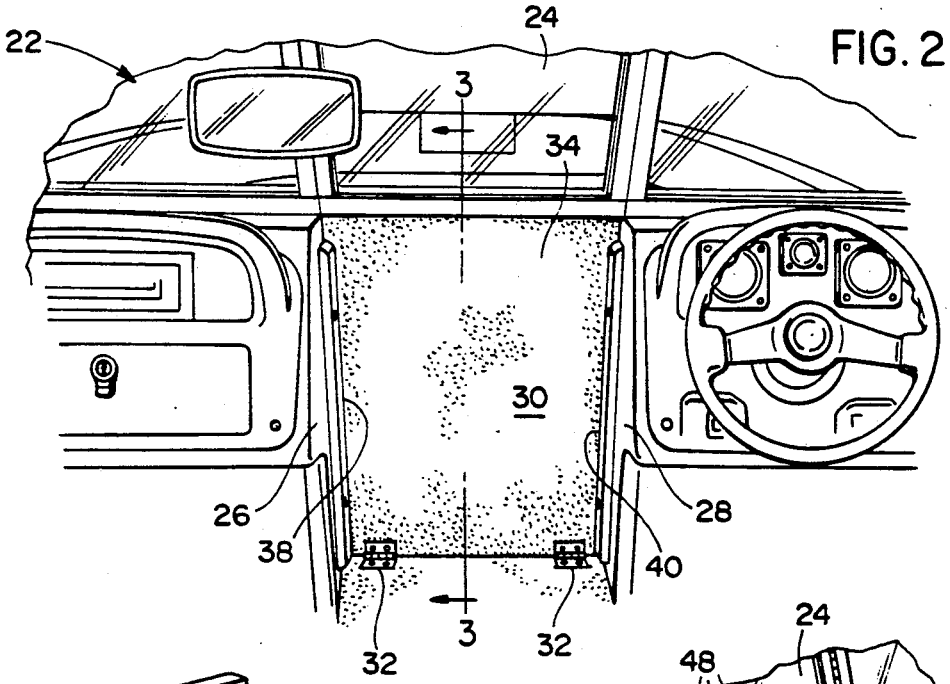
FIG. 2 is an elevational view of the panel from the cockpit of the boat.
Figure 5:
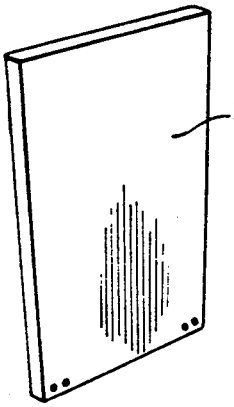
FIG. 5 is a perspective view of the panel.

FIGS. 1 to 4 show a common form of recreational motor boat 10 in which a cockpit 12 is separated from a forward compartment 14 by port and starboard consoles 16, 18 respectively with a space 20 between the consoles providing communication between the compartments, and a windshield 22 with a hinged central section 24. In the case of a molded fiberglass or like boat, the side walls 26, 28 of the consoles are slightly tapered downwardly to allow withdrawal from a mold.

In order to close off the forward compartment from the cockpit, for example, in the event of inclement weather, the boat is provided, in accordance with the invention, with a tilt-up panel 30 attached by hinges 32 to the floor of the boat across space 20. The panel is dimensioned to fit snugly within space 20 (including tapered side walls if applicable) and may conveniently fit, when not in use in a recess or well 33 in the floor of the forward compartment. The panel may be made of plastic or plywood with a resin coating and may have a covering 34 corresponding to the floor covering of the boat. An operating handle or strap 36 may also be provided.

Figure 6:
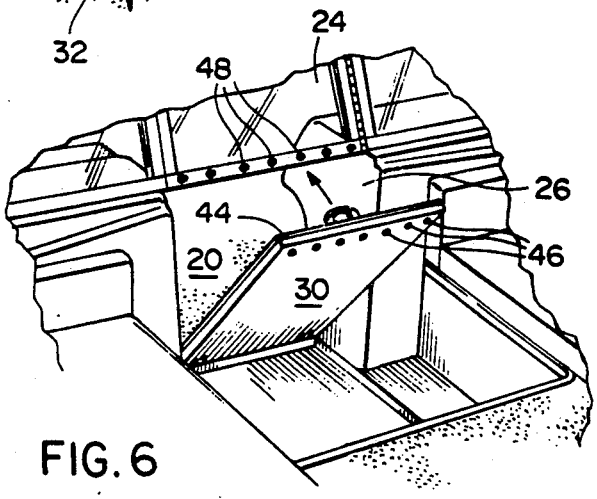
FIG. 6 is a view similar to FIG. 1 showing a modified panel.
Figure 3:
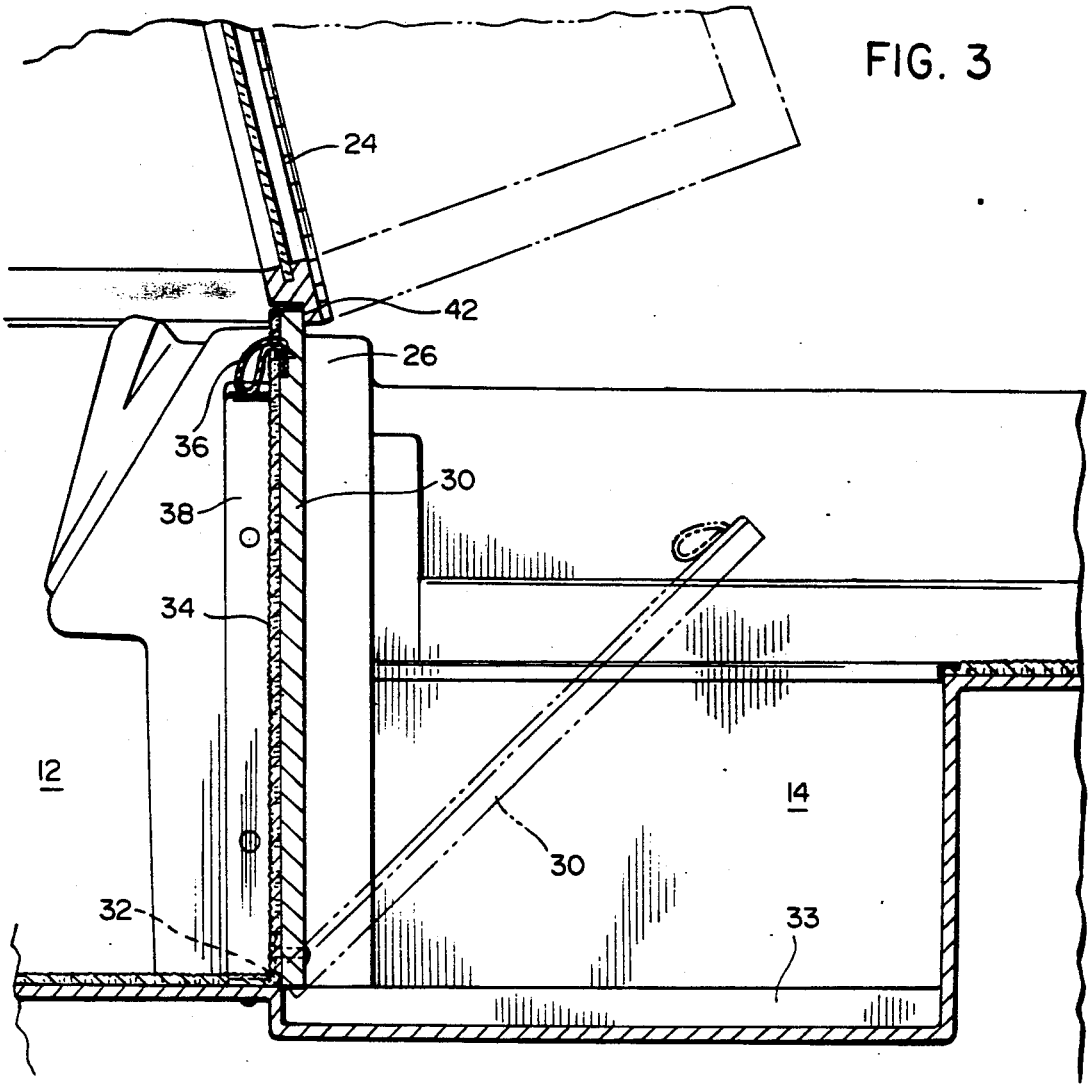
FIG. 3 is an enlarged sectional view on line 3—3 of FIG. 2.
Figure 4:
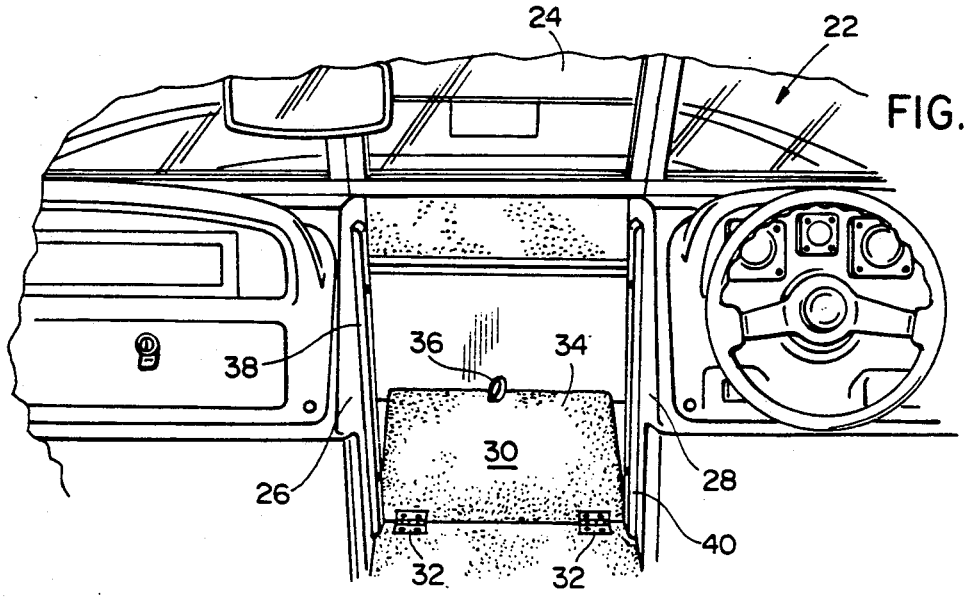
FIG. 4 is a view similar to FIG. 2 with the panel in lowered position.

To locate the panel in an operative lifted position in space 20, it may come up against stops 38, 40 secured to the respective side walls 26, 28, and to secure the panel in the upright position, it may have a top edge 42 (FIG. 3) against which the central section 24 of the windshield 2 hinges closed. In a modified form of the invention shown in FIG. 6, the top edge 44 of the panel may have fastener elements 46 which secure against complimentary fastener elements 45 o the lower edge of windshield section 24. In this arrangement, the stops 38, 40 can be eliminated. In a further modification of the invention, not shown in the drawings, the hinges 32 may be spaced somewhat forwardly of the consoles 16, 18 and the panel may have upstanding side flanges which, in the upright position of the panel fit against the consoles and in the down position of the panel fit against side walls of the forward compartment.

It is evident that the lift-up panel forms simple and convenient means for sealing space 20 for wind and water exclusion.

While only preferred forms of the invention have been described in detail, the invention is not limited thereby and modifications can be made within the scope of the attached claims.

I claim:

1. A boat having a cockpit, a forward compartment separated from the cockpit by port and starboard consoles with a communication space therebetween, and a panel for closing off the cockpit from the forward compartment, said panel being transversely hinged to a floor of the boat, the panel having a lowered inoperative position extending along the floor of the boat and an elevated operative position engaging against the respective consoles or against stops connected to the respective consoles to at least partially close off said space, wherein the boat includes a windshield with outer sections on the respective consoles and a hinged central section having a bottom edge which engages an upper edge of the panel to secure the panel in the operative position.

2. A boat as claimed in claim 1, wherein the consoles have side walls with stops against which the panel fits in the operative position and wherein said central section of the windshield closes against the upper edge of the panel.

3. A boat as claimed in claim 1 including complimentary fastener elements on the bottom edge of said central section and the top edge of the panel wherein the panel closes against the central section of the windshield.

4. A boat as claimed in claim 1, wherein the floor of the boat has a recess in which the panel fits in the inoperative position.

5. A boat as claimed in claim 4, wherein said recess is located in the forward compartment of the boat.

6. A boat as claimed in claim 1, wherein the panel has tapered side walls and the consoles have correspondingly tapered side walls.

* * * * *